US005350102A

United States Patent [19]

de Muijnck et al.

[11] Patent Number: 5,350,102

[45] Date of Patent: Sep. 27, 1994

[54] WIRE TRANSPORT APPARATUS

[75] Inventors: Andries C. de Muijnck, Heiloo; Johan W. Herman de Groot, Bloemendaal, both of Netherlands

[73] Assignee: Hoogovens Groep BV, Ijmuiden, Netherlands

[21] Appl. No.: 817,350

[22] Filed: Jan. 6, 1992

[30] Foreign Application Priority Data

Jan. 10, 1991 [NL] Netherlands ..... 9100028

[51] Int. Cl.[5] ..... B65H 20/00

[52] U.S. Cl. ..... 226/186; 226/174; 226/188; 226/190

[58] Field of Search ..... 226/187, 181, 188, 190, 226/177, 176, 174, 170, 195, 25, 26, 186; 474/134, 133, 8; 74/397, 399, 396

[56] References Cited

U.S. PATENT DOCUMENTS

| | | | |
|---|---|---|---|
| 3,022,929 | 2/1962 | Myers et al. | 226/184 |
| 3,913,814 | 10/1975 | Suzuki | 226/187 |
| 4,000,762 | 1/1977 | Mizuno | 221/187 X |
| 4,094,452 | 6/1978 | Makela | 226/186 X |
| 4,202,719 | 5/1980 | Linn | 226/181 X |
| 4,846,388 | 7/1989 | Benbow | 226/134 |

FOREIGN PATENT DOCUMENTS

| | | |
|---|---|---|
| 0016627 | 10/1980 | European Pat. Off. . |
| 1149841 | 1/1958 | France . |
| 1525567 | 5/1968 | France . |
| 2191543 | 2/1974 | France . |
| 2294117 | 7/1976 | France . |
| WO8403688 | 9/1984 | PCT Int'l Appl. . |

*Primary Examiner*—Daniel P. Stodola
*Assistant Examiner*—Michael R. Mansen
*Attorney, Agent, or Firm*—Stevens, Davis, Miller & Mosher

[57] ABSTRACT

A wire transport apparatus has a pair of rollers having opposed peripheral running surfaces which at their nip contact the wire to drive it, one of said rollers being driven. The driven roller is mounted on an arm swingable about a pivot axis. The arm also carrying a coupling pulley connected to the driven roller to drive it in rotation. The coupling pulley is itself driven in rotation by an endless flexible element whose tension tends to cause said driven roller to apply load to said wire. In order that variation of the tension in belt also adjusts the normal force applied to the wire by the driven roller, the pivot axis is parallel to the direction of wire travel, and the driven roller and the coupling pulley are on a common rotational axis perpendicular to the pivot axis, at different distances from the pivot axis. Excessive force on the wire is avoided, and wear is minimized.

8 Claims, 3 Drawing Sheets

PRIOR ART

WIRE TRANSPORT APPARATUS

BACKGROUND OF THE INVENTION

1. Field of the Invention

This invention relates to wire transport apparatus and to methods of wire transport, using opposed rollers which contact the wire at their nip to drive it along its direction of elongation.

2. Description of the Prior Art

EP-A-0138895 discloses a wire transport apparatus provided with rollers which form a gap at their nip between their peripheral surfaces for contacting the wire. One roller is driven and presses the wire against the other roller. A coupling pulley is coupled to the driven roller. A movable carrier is provided on which the driven roller and the coupling pulley are mounted. A flexible drive element runs around the running surface of the coupling pulley for driving the coupling pulley. A drive pulley drives the flexible element. This apparatus is further provided with a spring for exerting a specific additional normal force between the driven roller and the wire. Moreover, the drive pulley is suspended freely and coupled to a hydraulic servo-system in order to allow it to follow every movement of the driven roller.

In operation of this known apparatus, the spring force and the distance between the driven roller and the drive pulley is selected in such a way that the total normal force resulting from the spring force, from any pre-tension in the drive element and from the driving tensile force in the drive element is intended to provide slip-free conveying. However, when conveying a steel wire, it is found in practice that, in order to prevent slip, the normal force has to be increased after only a brief period of use. This is done by increasing the spring force and/or the pre-tension in the drive element. This contribution to the normal force is made so large that slip-free wire conveying is accomplished even under the highest opposing resisting force acting on the wire from outside the apparatus. Since this contribution to the normal force is continuously applied and is roughly constant, it does not diminish correspondingly with a lower resisting force acting on the wire. Consequently the normal force for each resisting force which is smaller than the maximum is unnecessarily high. This excess of normal force leads to accelerated wear so that slip soon occurs and the contribution to the normal force has to be increased once again. In this way, at a coefficient of friction of 0.3 and under a resisting force of 10% of the maximum resisting force, the normal force quickly attains more than 20 times the normal force needed, this being a problem that the known wire conveying apparatus was supposed to prevent. The coefficient of friction is defined here as the maximum friction force occurring with a normal force exerted perpendicularly on friction surfaces at which the driven roller and the wire touch each other, divided by the normal force.

FR-A-2294117 illustrates a different form of wire transport apparatus, in which a driven roller of a wire-contacting roller pair is co-axial with a drive roller which engages a conical driving member. The driven roller and drive roller are mounted on an arm, on an axis transverse to the arm, which can swing for adjustment of the position of the drive roller on the conical member, in order to vary the drive speed.

SUMMARY OF THE INVENTION

The object of the invention is to provide a wire transport apparatus by which the problem indicated above is solved or at least reduced and in particular in which slip-free wire transport can be achieved over a wide operational range without high wear.

The present invention is based on the novel concept of arranging the parts of the apparatus so that the tension in the flexible elongate driving element, which is related at all times to the longitudinal force applied by the driven roller to the wire, adjusts the normal force applied by the driven roller to the wire so that the ratio of the longitudinal force to the normal force remains always slightly below the coefficient of friction. This avoids slippage of the wire relative to the driven roller, since the normal force is always slightly greater than the minimum determined by the coefficient of friction. This result can be effectively achieved over a wider range of operational conditions, preferably over the whole range of operational longitudinal forces desired for the operation of the apparatus. At the same time, wear is reduced or minimized.

The tension in the flexible elongate element driving the coupling pulley is generally directly related to the power required to drive the wire, i.e. to overcome the resistance of the wire to longitudinal movement in the desired direction. For example, where a constant speed of wire travel is maintained, the driving force, which is conveyed by the tension in the elongate flexible element, varies according to the resisting force exerted by the wire. Increase in the driving force, according to the invention, increases both the longitudinal and normal components of the force applied by the driven roller to the wire. In this way excessive normal forces are avoided, minimizing wear of the driven roller.

The invention is also especially applicable for example where the wire transport apparatus is moving the wire to a bundling device, the wire being used to tie the bundles, e.g. bundles of rods. In this case, the wire transport direction may be reversed, in order to tension a wire around the bundle. The apparatus of the invention can be reversible and can apply the high forces necessary to achieve this.

In one aspect therefore, the invention provides wire transport apparatus having a pair of rollers having opposed peripheral running surfaces which at their nip contact the wire to drive it, one of the rollers being driven. The driven roller is mounted on an arm swingable about a pivot axis, the arm also carrying a coupling pulley connected to the driven roller to drive it in rotation. The coupling pulley is itself driven in rotation by an endless flexible element whose tension tends to cause said driven roller to apply load to said wire. The pivot axis is parallel to the direction of wire travel, and the driven roller and the coupling pulley are on a common rotational axis perpendicular to the pivot axis, at different distances from said pivot axis.

Preferably the coupling pulley is more remote from the pivot axis than the driven roller. Preferably the distance of the coupling pulley from the pivot axis is at least 1.25 times the distance of the driven roller from the pivot axis.

Suitably, the driven roller has a trapezoidal groove in its peripheral surface, to receive the wire. The groove angle affects the ratio of the longitudinal and normal forces applied to the wire. Preferably the trapezoidal groove has a wedge angle ($\alpha$) of at least 25°. The driven roller may comprise two bevelled pulley parts, whose bevelled surfaces provide the trapezoidal groove, the axial spacing of these parts being adjustable.

Preferably the diameter of the coupling pulley is not more than 0.75 times the diameter of the driven roller.

The angle of the tensioned run of the elongate flexible element extending away from the coupling pulley also influences the ratio of the longitudinal and normal forces applied to the wire. Suitably the path portion of said flexible element at which the element moves away from said coupling pulley is deflected by a deflection member, to provide a predetermined angle between the tension force exerted on the coupling pulley by the element and the wire travel direction.

It is also possible for an untensioned path portion of the flexible element to be guided by an adjustable guide member.

In another aspect, the invention provides a method of wire transport, using wire transport apparatus having a pair of rollers having opposed peripheral running surfaces which at their nip contact the wire to drive it, one of said rollers being driven. The driven roller is mounted on an arm swingable about a pivot axis. The arm also carries a coupling pulley connected to the driven roller to drive it in rotation. The coupling pulley is itself driven in rotation by an endless flexible element whose tension tends to cause said driven roller to apply load to said wire. One or more of the following quantities:

(a) the radii ratio of the driven roller and the connecting pulley, (b) the ratio between the distances of the driven roller and the coupling pulley from the pivot axis, the driven roller and the coupling pulley lying spaced apart on a common axis perpendicular to the pivot axis, and the pivot axis being parallel to the direction of wire travel, (c) the wedge angle ($\alpha$) of a trapezoidal groove in the driven roller which receives the wire, and (d) the angle between the wire travel direction and the tension force exerted by said flexible element on the coupling pulley, has or have a value or values such that, for all operational values of said longitudinal force and the values of said tension of said endless flexible element related to said values of longitudinal force, the ratio between the longitudinal force and the normal force between the wire and the driven roller is maintained at between 75 and 100% of the coefficient of friction therebetween.

The invention further consists in a method of wire transport, using wire transport apparatus having a pair of rollers having opposed peripheral running surfaces which at their nip contact the wire to drive it, one of said rollers being driven. The driven roller is mounted on an arm swingable about a pivot axis. The arm also carries a coupling pulley connected to the driven roller to drive it in rotation. The coupling pulley is itself driven in rotation by an endless flexible element whose tension causes the driven roller to apply longitudinal and normal forces to said wire. The arrangement and dimensions of the driven roller, the coupling pulley and the elongate flexible element are such that the ratio of the longitudinal and normal forces applied by the driven roller to the wire is maintained at between 75 and 100% of the coefficient of friction therebetween over the whole desired operational range of the longitudinal force.

Preferably also the ratio of the perpendicular distance from the centers of the running surfaces of the coupling pulley and the driven roller is adjustable. This also enables the ratio of longitudinal and normal forces to be altered.

BRIEF DESCRIPTION OF THE DRAWINGS

The invention will now be illustrated by way of non-limitative example with reference to the drawings in which.

Identical numbers in the Figures indicate corresponding components of the wire conveying apparatuses.

DESCRIPTION OF THE PREFERRED EMBODIMENTS

Figure 1:
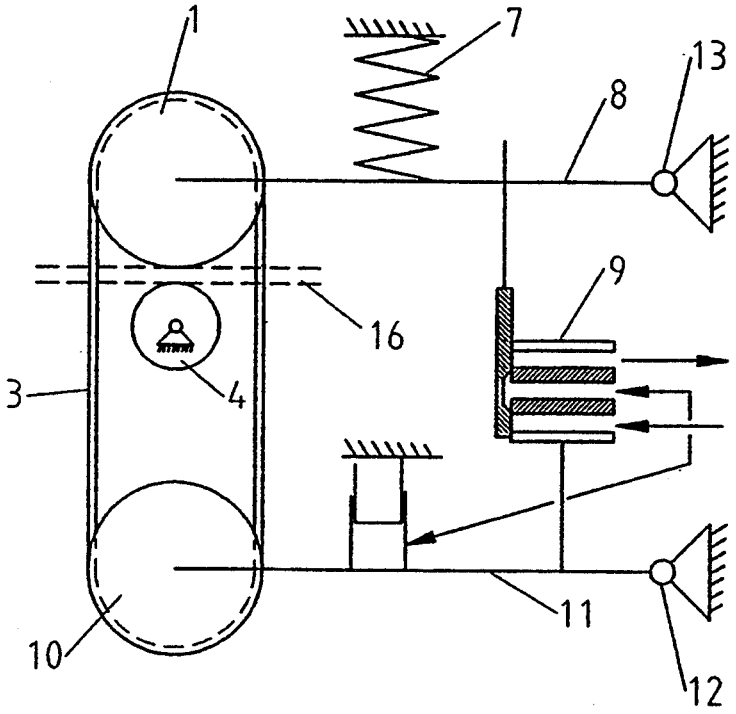
FIG. 1 shows the wire conveying apparatus in accordance with the state of the art, referred to above.

In FIG. 1 the known wire conveying apparatus is shown. In the known wire conveying apparatus the wire 16 is fed in between a driven roller 1 and a pressure roller 4, and is conveyed because the driven roller 1 is driven by a drive pulley 10 via an endless elongate element 3 in the form of a belt. In addition to a resisting force to be overcome, also acting on the wire 16 are a component of the tensile force in the part of the belt running off the coupling pulley 2, a component of any pre-tension in the belt 3 and a component of the spring force exerted by a spring 7. The hydraulic servo-system 9 causes the drive pulley 10 to follow a movement of the driven roller 1, for example, in the event of a thicker wire being fed in. The driven roller 1 is mounted on a carrier 8, while the drive pulley 10 is mounted on a carrier 11. Both carriers 8 and 11 are suspended pivotally around pivots 12 and 13 which are located parallel to the axes of rotation of the roller 1 and pulley 10. The disadvantage of this apparatus is discussed above.

Figure 2:
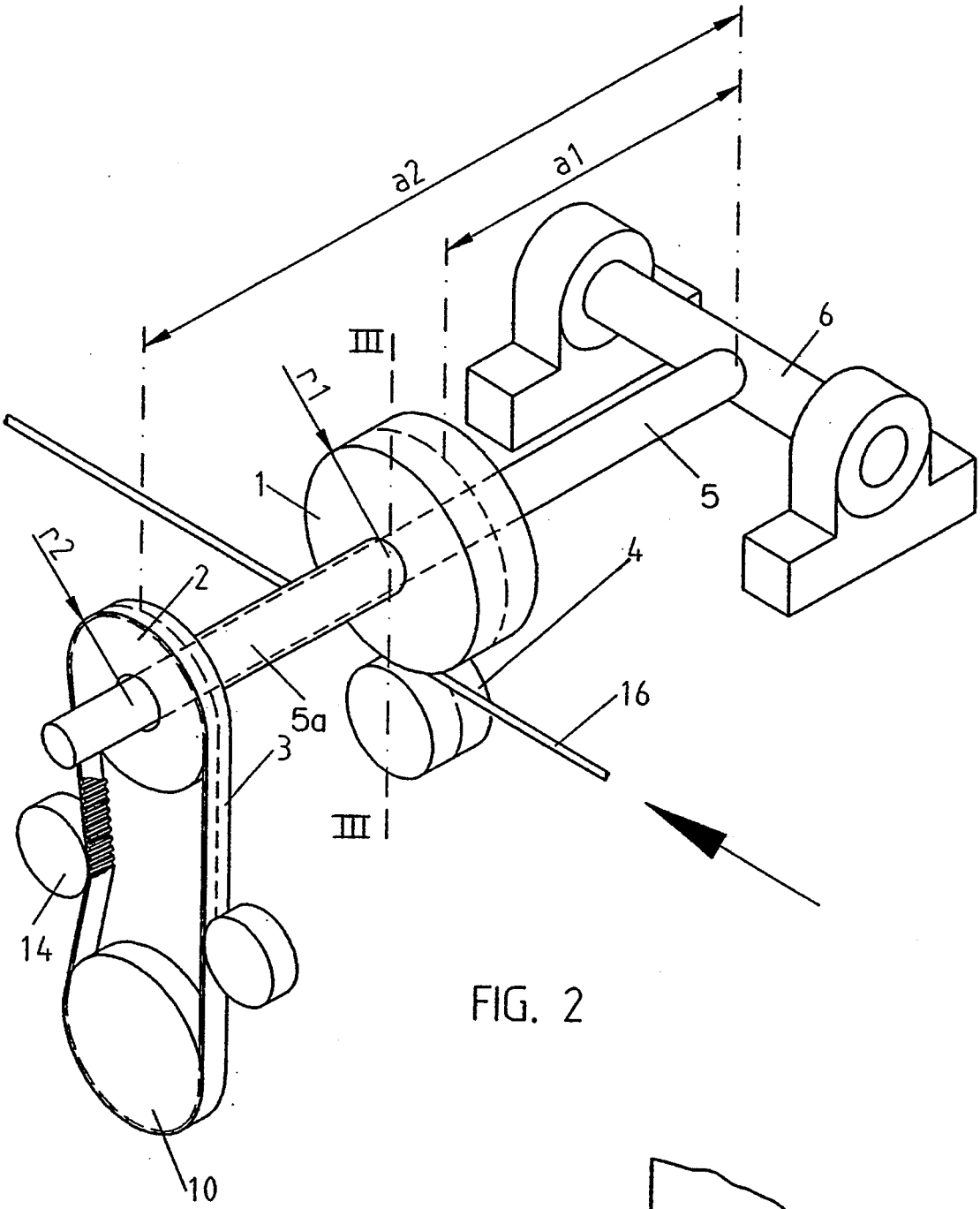
FIG. 2 shows an embodiment of the wire conveying apparatus in accordance with the invention.

In FIG. 2 an embodiment of the wire conveying apparatus in accordance with the invention is shown. In this, the wire 16 is fed in between the driven roller 1 and the pressure roller 4, and is conveyed because the driven roller 1 is driven by the drive pulley 10 via a coupling pulley 2 and the belt 3. The coupling pulley 2 and the driven roller 1 are coupled together by a sleeve 5*a* which is freely rotatable on an arm 5. The arm 5 is pivotally mounted on a rod 6 which defines a pivot axis parallel to the wire transport direction indicated by the arrow.

The peripheral running surfaces of the driven roller 1 and the coupling pulley 2 have different, predetermined radii of curvature $r_1$ and $r_2$ respectively. The arm 5 is free to rotate around the pivot 6, and the different perpendicular distances (a1,a2) from the centers of the driven roller 1 and the coupling pulley 2 to the pivot axis are selected to provide a specific lever ratio. Simple adjustability can be achieved by making the position of the pivot axis 6 adjustable relative to the sleeve 5*a*, or alternatively or in combination with that, by making the distance between the coupling pulley 2 and the driven roller 1 adjustable.

Figure 3:
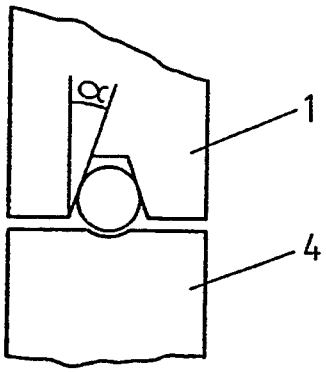
FIG. 3 shows a cross-section of the apparatus in accordance with the invention according to the line III—III in FIG. 2.

The driven roller 1 is provided with a trapezoidal groove for the wire with wedge angle $\alpha$ (see FIG. 3).

Figure 4:
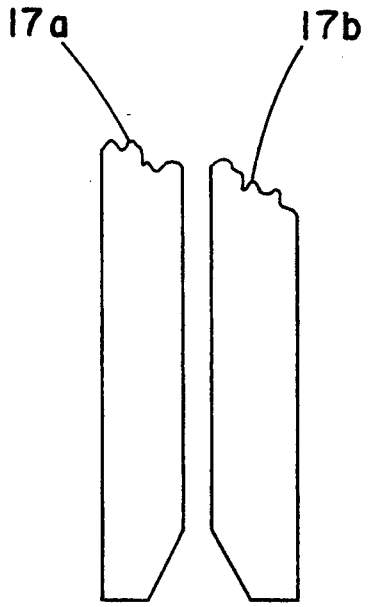
FIG. 4 shows a cross-section of a portion of the driven roller consisting of two bevelled pulley halves.

The trapezoidal groove may be formed because the driven roller 1 consists of two bevelled pulley halves 17*a* and 17*b* (see FIG. 4) whose relative spacing is adjustable in a manner not shown.

As shown, the tensioned portion of the belt 3 running away from the coupling pulley 2 is at 90° to the travel direction of the wire 16. Alternatively, the portion of the drive element 3 running away from the coupling pulley 2 is deflected by a deflector roller so that a specific desired angle occurs between the direction of wire travel and the tensile force acting on the coupling pulley 2. The latter embodiment is not shown in the Figures.

The belt 3 is preferably fitted without pre-tension; the stress-free part is then guided, for example, by guiding means 14.

As already discussed fully above, the invention lies in the arrangement of the parts so that increased tension in the belt 3, resulting from increased power applied by means driving the driving pulley 10, causes automatically an increase in both the longitudinal force component and the normal force component at the contact region of the wire 16 and the driven roller 1. By the appropriate selection of the relevant features, such as (i) the lever ratio, at the pivot axis 6, of the driven roller 1 and the coupling pulley 2, (ii) the radii ratio of the driven roller 1 and the coupling pulley 2, (iii) the wedge angle $\alpha$ of the groove in the driven roller 1 and (iv) the direction of the tensioned run of the belt 3 running away from the pulley 2, this ratio of the longitudinal and normal force components is maintained at between 75 and 100% of the coefficient of friction for all operational conditions.

Thus, during operation, the ratio between the longitudinal force occurring along friction surfaces at which the driven roller 1 and the wire 16 touch each other, and a normal force perpendicular to that longitudinal force, is Just smaller than the coefficient of friction between the wire 16 and the running surfaces touching it.

The measures employed in this embodiment will now be further illustrated by reference to two non-limitative examples where the coefficient of friction is taken as 0.35. The measures are directed at making the ratio between the longitudinal and the normal forces occurring at the wire just smaller than 0.35, for example 0.31.

EXAMPLE 1

The radius of curvature $r_2$ of the running surface of the coupling pulley 2 is 35 mm and the radius of curvature $r_1$ of the running surface of the driven roller 1 is 90 mm, a2 is equal to 125 mm, a1 is selected to equal 100 mm. The groove in the driven roller 1 (see FIG. 3) has a wedge angle $\alpha$ equal to 90°, the angle between the belt tensile force acting on the coupling pulley 2 and the direction of wire travel is likewise 90°. The force ratio mentioned for this is thus: (35/90).(100/125).(sin 90°)/(sin 90°)=0.31.

EXAMPLE 2

The radius of curvature $r_2$ of the running surface of the coupling pulley 2 is 40 mm and the radius of curvature $r_1$ of the running surface of the driven roller 1 is 80 mm, a2 is equal to 150 mm, a1 is selected to equal 90 mm. The groove in the conveyor pulley 1 is trapezoidal with a wedge angle $\alpha$ equal to 60° and the angle between the belt tensile force acting on the coupling pulley and the direction of wire travel is 57°. The relevant force ratio occurring at the time is then: (40/80).(90/150).(sin 60°)/(sin 57°)=0.31.

What is claimed is:

1. Wire transport apparatus having a pair of wire-contracting rollers, one of which is a driven roller, said rollers having mutually opposed peripheral running surfaces and arranged to provide a nip at which said running surfaces in use contact the wire to transport it in a wire travel direction, an arm pivotable about a pivot axis, said pivot axis being parallel to said wire transport direction, a coupling pulley drivingly connecting to said driven roller and co-axial therewith on a common rotational axis which is perpendicular to said pivot axis, said coupling pulley and said driven roller being mounted on said arm and being spaced apart and at different distances from said pivot axis, means for driving said coupling pulley in rotation including an elongate flexible element running around said coupling pulley and arranged so that tension in said flexible element causes said driven roller to apply load to said wire.

2. Wire transport apparatus according to claim 1 wherein said distance of said coupling pulley from said pivot axis is at least 1.25 times said distance of said driven roller from said pivot axis.

3. Wire transport apparatus according to claim 1 wherein said driven roller has a trapezoidal groove in its peripheral running surface, to receive the wire.

4. Wire transport apparatus according to claim 3 wherein said trapezoidal groove has a wedge angle ($\alpha$) of at least 25°.

5. Wire transport apparatus according to claim 3 wherein said driven roller comprises two bevelled pulley parts, whose bevelled surfaces provide non-parallel sides of said trapezoidal groove.

6. Wire transport apparatus according to claim 1 wherein the diameter of said coupling pulley is not more than 0.75 times the diameter of said driven roller.

7. Wire transport apparatus according to claim 1 wherein said flexible element has a path portion at which the element moves away from said coupling pulley, there being a deflection member deflecting said path portion so as to provide a predetermined angle between the tension force exerted on said coupling pulley by said flexible element and said wire transport direction.

8. Wire transport apparatus according to claim 1 wherein said flexible element has an untensioned path portion of at which said flexible element is guided by an adjustable guide member.

* * * * *